US009568846B2

(12) United States Patent
Kawaguchi et al.

(10) Patent No.: US 9,568,846 B2
(45) Date of Patent: Feb. 14, 2017

(54) ELECTROPHOTOGRAPHIC PHOTOSENSITIVE MEMBER, METHOD FOR PRODUCING THE SAME, PROCESS CARTRIDGE, AND ELECTROPHOTOGRAPHIC APPARATUS

(71) Applicant: CANON KABUSHIKI KAISHA, Tokyo (JP)

(72) Inventors: Daisuke Kawaguchi, Toride (JP); Daisuke Tanaka, Yokohama (JP); Kazumichi Sugiyama, Numazu (JP); Takeshi Murakami, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/949,604

(22) Filed: Nov. 23, 2015

(65) Prior Publication Data

US 2016/0154329 A1 Jun. 2, 2016

(30) Foreign Application Priority Data

Nov. 28, 2014 (JP) ..... 2014-242597

(51) Int. Cl.
*G03G 5/14* (2006.01)
*G03G 5/04* (2006.01)

(52) U.S. Cl.
CPC ..... *G03G 5/144* (2013.01); *G03G 5/04* (2013.01)

(58) Field of Classification Search
CPC ..... G03G 5/04; G03G 5/144
See application file for complete search history.

(56) References Cited

U.S. PATENT DOCUMENTS 4,734,735 A 3/1988 Haneda
5,087,517 A * 2/1992 Sagawa ..... G03G 5/0202 428/323
5,349,426 A 9/1994 Kudoh
5,517,289 A 5/1996 Ito
5,660,961 A * 8/1997 Yu ..... G03G 5/144 430/65
5,670,284 A * 9/1997 Kishi ..... G03G 5/0514 430/57.1

(Continued)

FOREIGN PATENT DOCUMENTS

JP H05210300 A 8/1993
JP H10207186 A 8/1998

(Continued)

OTHER PUBLICATIONS

Machine translation of JP 2007187771 A.*

(Continued)

*Primary Examiner* — David Bolduc
(74) *Attorney, Agent, or Firm* — Canon U.S.A., Inc. IP Division

(57) ABSTRACT

An undercoat layer of an electrophotographic photosensitive member contains zinc oxide particles subjected to a surface treatment with an organometallic compound or an organosilicon compound and titanium oxide particles subjected to a surface treatment with an organometallic compound or an organosilicon compound. The titanium oxide particles have an average primary particle diameter of 100 nm or more and 600 nm or less. A volume ratio of the titanium oxide particles represented by formula (1) is 1.0 or more and 25 or less.

15 Claims, 1 Drawing Sheet

(56) References Cited

U.S. PATENT DOCUMENTS 6,355,390 B1 * 3/2002 Yamanami ..... G03G 5/144 399/130
7,556,903 B2 * 7/2009 Yanagawa ..... G03G 5/0542 399/159
2001/0044063 A1 * 11/2001 Hamaguchi ..... G03G 5/144 430/63
2003/0113645 A1 * 6/2003 Suzuki ..... C08K 3/22 430/60
2003/0175605 A1 * 9/2003 Katayama ..... G03G 5/144 430/59.4
2003/0228172 A1 12/2003 Nakamura
2004/0043315 A1 3/2004 Takiguchi
2004/0214100 A1 * 10/2004 Yu ..... G03G 5/0517 430/58.8
2005/0069797 A1 * 3/2005 Niimi ..... G03G 5/0696 430/78
2005/0100806 A1 * 5/2005 Hongo ..... C09B 67/0022 430/78
2006/0008719 A1 * 1/2006 Niimi ..... G03G 5/0557 430/59.1
2006/0240346 A1 * 10/2006 Toda ..... G03G 5/0514 430/64
2008/0124641 A1 * 5/2008 Toriyama ..... G03G 5/144 430/84
2009/0010664 A1 * 1/2009 Nukada ..... G03G 5/10 399/49
2009/0060574 A1 * 3/2009 Shibata ..... G03G 21/08 399/128
2009/0142093 A1 6/2009 Sawada
2009/0311011 A1 12/2009 Hayase
2010/0021835 A1 * 1/2010 Akiyama ..... G03G 5/08228 430/57.1
2011/0020739 A1 * 1/2011 Nakamura ..... G03G 5/0571 430/56
2011/0269062 A1 11/2011 Tong
2011/0269063 A1 11/2011 Wu
2012/0008984 A1 * 1/2012 Kami ..... G03G 5/0525 399/159
2012/0034556 A1 * 2/2012 Nebashi ..... G03G 5/142 430/65
2012/0051786 A1 * 3/2012 Katayama ..... C09D 177/00 399/159
2012/0052423 A1 * 3/2012 Maruyama ..... G03G 5/0521 430/56
2012/0070188 A1 * 3/2012 Hirakoso ..... G03G 15/0233 399/111
2012/0114375 A1 5/2012 Fujii
2012/0263499 A1 10/2012 Yamauchi
2013/0164671 A1 6/2013 Matsui
2013/0323632 A1 * 12/2013 Fujii ..... G03G 5/104 430/56
2014/0038094 A1 * 2/2014 Hamaguchi ..... G03G 5/144 430/64
2014/0065529 A1 3/2014 Fujii
2014/0178809 A1 * 6/2014 Matsusaki ..... G03G 5/144 430/60
2015/0205218 A1 * 7/2015 Tsuji ..... G03G 5/104 430/56
2015/0241800 A1 * 8/2015 Tomono ..... G03G 5/104 430/56
2015/0241803 A1 8/2015 Ikari
2015/0331346 A1 11/2015 Yamauchi
2016/0026099 A1 1/2016 Tokimitsu

FOREIGN PATENT DOCUMENTS

JP H10312102 A 11/1998
JP 2002123046 A 4/2002
JP 2005140945 A 6/2005
JP 2007187771 A 7/2007
JP 2008070518 A 3/2008
JP 2008299020 A 12/2008

OTHER PUBLICATIONS

U.S. Appl. No. 14/949,257, filed Nov. 23, 2015, first named inventor Kazumichi Sugiyama.
U.S. Appl. No. 14/949,295, filed Nov. 23, 2015, first named inventor Daisuke Tanaka.

* cited by examiner

ELECTROPHOTOGRAPHIC PHOTOSENSITIVE MEMBER, METHOD FOR PRODUCING THE SAME, PROCESS CARTRIDGE, AND ELECTROPHOTOGRAPHIC APPARATUS

BACKGROUND OF THE INVENTION

Field of the Invention

The present invention relates to an electrophotographic photosensitive member, a method for producing the same, and a process cartridge and an electrophotographic apparatus that include the electrophotographic photosensitive member.

Description of the Related Art

An example of an electrophotographic photosensitive member installed in a process cartridge or an electrophotographic apparatus includes a support, an undercoat layer containing metal oxide particles and disposed on the support, and a photosensitive layer disposed on the undercoat layer.

In the digital image formation, which is widely used in recent years, when image information that has been converted to a digital electrical signal is written on a photosensitive member as an electrostatic latent image, a laser, in particular, a semiconductor laser or a light-emitting diode (LED) is used as a light source. However, in the electrostatic latent image formation using a laser beam, there may be a particular image problem in that interference fringes are generated due to the reflection on the surface of an electrophotographic photosensitive member.

In order to suppress such interference fringes, Japanese Patent Laid-Open No. 2007-187771 discloses an under coat layer in which two types of metal oxide particles having different average particle diameters are dispersed in a resin. Japanese Patent Laid-Open No. 2008-299020 discloses an undercoat layer containing titanium oxide, zinc oxide subjected to a surface treatment with a reactive organosilicon compound, and a binder resin.

SUMMARY OF THE INVENTION

An electrophotographic photosensitive member according to a first aspect of the present invention includes a support, an undercoat layer on the support, and a photosensitive layer on the undercoat layer. The undercoat layer contains zinc oxide particles subjected to a surface treatment with an organometallic compound or an organosilicon compound and titanium oxide particles subjected to a surface treatment with an organometallic compound or an organosilicon compound. The titanium oxide particles have an average primary particle diameter of 100 nm or more and 600 nm or less. A volume ratio of the titanium oxide particles represented by formula (1) below is 1.0 or more and 25 or less.

$$\frac{R2 \times S2}{R1 \times S1 + R2 \times S2} \times 100 \quad (1)$$

In formula (1), R1 represents an average primary particle diameter of the zinc oxide particles, R2 represents an average primary particle diameter of the titanium oxide particles, S1 represents an area ratio of the zinc oxide particles relative to a total area of the zinc oxide particles and the titanium oxide particles per unit area of the undercoat layer, and S2 represents an area ratio of the titanium oxide particles relative to the total area of the zinc oxide particles and the titanium oxide particles per unit area of the undercoat layer.

A process cartridge according to a second aspect of the present invention is detachably attachable to a main body of an electrophotographic apparatus. The process cartridge includes the electrophotographic photosensitive member according to the first aspect of the present invention and at least one device selected from the group consisting of a charging device, a developing device, and a cleaning device. The electrophotographic photosensitive member and the at least one device are integrally supported.

An electrophotographic apparatus according to a third aspect of the present invention includes the electrophotographic photosensitive member according to the first aspect of the present invention, a charging device, an exposure device, a developing device, and a transfer device.

An electrophotographic photosensitive member according to a fourth aspect of the present invention includes a support, an undercoat layer on the support, and a photosensitive layer on the undercoat layer. The undercoat layer contains zinc oxide particles subjected to a surface treatment with an organometallic compound or an organosilicon compound and titanium oxide particles. The titanium oxide particles have an average primary particle diameter of 100 nm or more and 600 nm or less. A volume ratio of the titanium oxide particles represented by formula (1) above is 1.0 or more and 25 or less. The titanium oxide particles satisfy formula (2) below.

$$D1/R2 \leq 1.2 \quad (2)$$

In formula (2), D1 represents a circle-equivalent diameter of the titanium oxide particles in the undercoat layer, and R2 has the same definition as R2 in formula (1) above.

Further features of the present invention will become apparent from the following description of exemplary embodiments with reference to the attached drawings.

DESCRIPTION OF THE EMBODIMENTS

Figure 1:
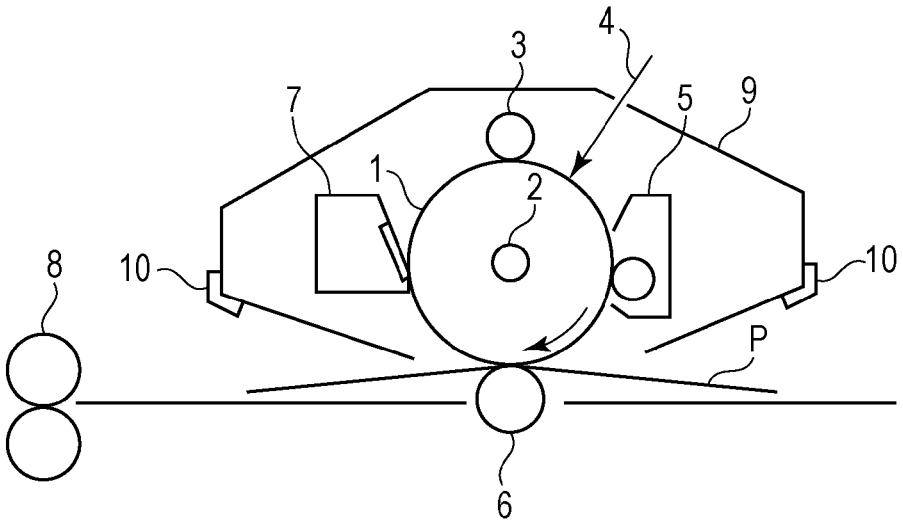
FIG. 1 is a view illustrating an example of the schematic structure of an electrophotographic apparatus that includes a process cartridge including an electrophotographic photosensitive member according to an embodiment of the present invention.

The results of examinations conducted by the inventors of the present invention showed that, in an undercoat layer in which zinc oxide particles and titanium oxide particles are dispersed in a resin, the effect of suppressing black spots and the effect of suppressing potential variations when the resulting electrophotographic photosensitive member is repeatedly used in a high-temperature high-humidity environment are not sufficient. It is believed that the zinc oxide particles and the titanium oxide particles are aggregated due to dispersion failure, and consequently, the effect of suppressing potential variations and the effect of suppressing black spots become insufficient.

The present invention provides an electrophotographic photosensitive member that suppresses the generation of interference fringes, and that has a good effect of suppressing black spots and a good effect of suppressing potential variations when repeatedly used in a high-temperature high-humidity environment, and a method for producing the electrophotographic photosensitive member.

The present invention provides a process cartridge and an electrophotographic apparatus that include the electrophotographic photosensitive member.

An electrophotographic photosensitive member according to an embodiment of the present invention includes a support, an undercoat layer on the support, and a photosensitive layer on the undercoat layer. The undercoat layer contains zinc oxide particles and titanium oxide particles.

The zinc oxide particles are particles subjected to a surface treatment with an organometallic compound or an organosilicon compound. The titanium oxide particles have an average primary particle diameter of 100 nm or more and 600 nm or less. The titanium oxide particles may be particles subjected to a surface treatment with an organometallic compound or an organosilicon compound.

A volume ratio of the titanium oxide particles represented by formula (1) below is 1.0 or more and 25 or less.

$$\frac{R2 \times S2}{R1 \times S1 + R2 \times S2} \times 100 \quad (1)$$

In formula (1), R1 represents an average primary particle diameter of the zinc oxide particles. R2 represents an average primary particle diameter of the titanium oxide particles. S1 represents an area ratio of the zinc oxide particles relative to a total area of the zinc oxide particles and the titanium oxide particles per unit area of the undercoat layer. S2 represents an area ratio of the titanium oxide particles relative to the total area of the zinc oxide particles and the titanium oxide particles per unit area of the undercoat layer.

Regarding the reason why the electrophotographic photosensitive member that includes an undercoat layer having the above structure exhibits a good effect of suppressing black spots and a good effect of suppressing potential variations when repeatedly used in a high-temperature high-humidity environment and suppresses the generation of interference fringes, the inventors of the present invention assume as follows.

In order to suppress interference fringes, to improve a masking property of defects on a support, and to suppress black spots, zinc oxide particles and titanium oxide particles were incorporated in an undercoat layer. As a result of the studies conducted by the inventors of the present invention, the following was found. When titanium oxide particles are incorporated in a high content so as to improve the masking property of defects on the support and to improve the effect of suppressing interference fringes, the titanium oxide particles tend to aggregate and potential variations and black spots are easily generated by repeated use. In contrast, when the content of titanium oxide particles in the undercoat layer is decreased, potential variations and the generation of black spots can be suppressed. However, the masking property of defects on the support is not sufficient, and the generation of interference fringes may easily occur.

It was found that, even when the volume ratio of titanium oxide particles is in the above range, the effect of masking defects on the support and the effect of suppressing interference fringes are sufficiently exhibited by treating the surfaces of the titanium oxide particles and zinc oxide particles with an organometallic compound or an organosilicon compound. The reason for this is believed to be as follows. The surface treatment of titanium oxide particles improves dispersibility of the titanium oxide particles, and the titanium oxide particles are uniformly present in the undercoat layer. Therefore, even in an undercoat layer having a low volume ratio of titanium oxide particles, the effect of masking defects on the support and the effect of suppressing interference fringes are exhibited. It is also believed that since the volume ratio of titanium oxide particles is low, potential variations and the generation of black spots due to repeated use are sufficiently suppressed.

From the viewpoint of conductivity and suppression of interference fringes, the titanium oxide particles have an average primary particle diameter of 100 nm or more and 600 nm or less. When the average primary particle diameter is less than 100 nm, the effect of suppressing interference fringes is not sufficient, and interference fringes are easily generated. When the average primary particle diameter exceeds 600 nm, a non-uniform conductive path may be formed in the undercoat layer, and the generation of black spots easily occurs.

Herein, a dispersed state of the titanium oxide particles in the undercoat layer as a result of the surface treatment of the titanium oxide particles with an organometallic compound or an organosilicon compound is specified by satisfying formula (2) below.

$$D1/R2 \leq 1.2 \quad (2)$$

In formula (2), D1 represents a circle-equivalent diameter of the titanium oxide particles in the undercoat layer, and R2 has the same definition as R2 (average primary particle diameter of titanium oxide particles) in formula (1) above.

It is assumed that some of the titanium oxide particles in the undercoat layer are present in the form of primary particles, and some of the titanium oxide particles in the undercoat layer aggregate to each other and are present in the form of secondary particles. The circle-equivalent diameter D1 is determined by measuring the projected areas of primary particles and secondary particles of titanium oxide particles in the undercoat layer, determining the diameters equivalent to those of circles that have areas equal to the measured projected areas of the primary particles and secondary particles, and averaging the diameters. As represented by formula (2), D1/R2 is an indicator that is determined by dividing D1 determined above by the average primary particle diameter R2 of the titanium oxide particles, and that represents a ratio of aggregated titanium oxide secondary particles in the undercoat layer. When D1/R2 in formula (2) is 1.2 or less, the ratio of presence of secondary particles of the titanium oxide particles is low, and the titanium oxide particles are sufficiently uniformly dispersed in the undercoat layer. In contrast, when D1/R2 in formula (2) exceeds 1.2, the ratio of presence of secondary particles of the titanium oxide particles is high, and the dispersion of the titanium oxide particles in the undercoat layer is not sufficiently uniform. In the present invention, when D1/R2 in formula (2) is much smaller than 1.2, dispersibility of the titanium oxide particles is better. The lower limit of D1/R2 is not limited. When all the titanium oxide particles in the undercoat layer are present in the form of primary particles, D1/R2 in formula (2) becomes an ideal lower limit. The value of D1/R2 in that case is 1.0. A detailed method for measuring D1, R2, etc. will be described below.

Undercoat Layer

The undercoat layer according to an embodiment of the present invention contains zinc oxide particles and titanium oxide particles having an average primary particle diameter of 100 nm or more and 600 nm or less. The zinc oxide particles are particles subjected to a surface treatment with an organometallic compound or an organosilicon compound. The titanium oxide particles are particles subjected to a surface treatment with an organometallic compound or an organosilicon compound, or particles that satisfy formula (2) above.

Any known method may be employed as the surface treatment method of the zinc oxide particles and the titanium oxide particles. A dry method or a wet method is employed.

The material used in the surface treatment is an organometallic compound or an organosilicon compound. Specific examples thereof include silane coupling agents, titanate coupling agents, aluminum coupling agents, and surfactants. Among these, silane coupling agents are preferable, and silane coupling agents having an amino group are particularly preferable.

Specific examples of the silane coupling agents include N-2-(aminoethyl)-3-aminopropylmethyldimethoxysilane, 3-aminopropylmethyldiethoxysilane, (phenylaminomethyl) methyldimethoxysilane, N-2-(aminoethyl)-3-aminoisobutylmethyldimethoxysilane, N-ethylaminoisobutylmethyldiethoxysilane, N-methylaminopropylmethyldimethoxysilane, N-2-(aminoethyl)-3-aminopropyltrimethoxysilane, 3-aminopropylmethyldiethoxysilane, (phenylaminomethyl)trimethoxysilane, N-2-(aminoethyl)-3-aminoisobutyltrimethoxysilane, N-ethylaminoisobutyltriethoxysilane, and N-methylaminopropyltrimethoxysilane. However, the present invention is not limited thereto. These silane coupling agents may be used in combination of two or more compounds.

In the case where the surface treatment is performed by a dry method, while metal oxide particles are stirred using a mixer or the like with a high shear stress, an organic compound is added dropwise or atomized with dry air or nitrogen gas either directly or in the form of a solution dissolved in an organic solvent. During the addition or atomization, the process may be performed at a temperature equal to or lower than the boiling point of the solvent. After the addition or atomization, baking may be further performed at 100° C. or higher. The temperature and the time of the baking are determined in appropriate ranges.

In the surface treatment by a wet method, metal oxide particles are dispersed in a solvent using stirring, ultrasonic waves, a sand mill, an attritor, a ball mill, or the like, an organic compound is added thereto, the resulting mixture is stirred or dispersed, and the solvent is then removed. The solvent is removed by filtration or distillation. After the removal of the solvent, baking may be further performed at 100° C. or higher. The temperature and the time of the baking are not particularly limited as long as electrophotographic characteristics are obtained.

The amount of organosilicon compound or organometallic compound used for the surface treatment of the metal oxide particles (titanium oxide particles and zinc oxide particles) in the undercoat layer is not limited as long as electrophotographic characteristics are obtained. However, the amount of organosilicon compound or organometallic compound is preferably 0.5% by mass or more and 20% by mass or less.

The average primary particle diameter of the zinc oxide particles is not particularly limited as long as electrophotographic characteristics are obtained. From the viewpoint of conductivity, the average primary particle diameter of the zinc oxide particles is preferably 10 nm or more and 100 nm or less, and more preferably 20 nm or more and 80 nm or less. The method for measuring the average primary particle diameters of the titanium oxide particles and the zinc oxide particles in the undercoat layer is as follows.

A cross-sectional photograph of an undercoat layer containing metal oxide particles (titanium oxide particles and zinc oxide particles) is taken by a scanning electron microscope (SEM) on an enlarged scale. A cross-sectional photograph of the metal oxide particles whose elements are mapped by an elemental analysis device such as an X-ray microanalyzer (XMA) attached to the SEM is taken. The metal oxide particles (titanium oxide particles and zinc oxide particles) in the SEM photograph and the mapped image of the metal oxide particles are compared. Next, the projected areas of primary particles of the metal oxide particles present per unit area (5 μm×5 μm) are measured. Diameters equivalent to those of circles that have areas equal to the measured projected areas of the metal oxide particles are determined as primary particle diameters of the metal oxides. On the basis of the results, the average primary particle diameters of the metal oxide particles present in the unit area are calculated. The average primary particle diameter of the zinc oxide particles determined as described above is defined as R1, and the average primary particle diameter of the titanium oxide particles determined as described above is defined as R2.

The method for measuring the circle-equivalent diameter D1 of titanium oxide particles in the undercoat layer is as follows. A cross-sectional photograph of an undercoat layer containing titanium oxide particles is taken by a scanning electron microscope (SEM) on an enlarged scale. A cross-sectional photograph of the titanium oxide particles whose elements are mapped by an elemental analysis device such as an X-ray microanalyzer (XMA) attached to the SEM is taken. These cross-sectional photographs are compared. In order to determine D1, the titanium oxide particles in the SEM photograph and the mapped image of the titanium oxide particles are compared. Next, the projected areas of primary particles or secondary particles of the titanium oxide particles present per unit area (5 μm×5 μm) are measured. Diameters equivalent to those of circles that have areas equal to the measured projected areas of the titanium oxide particles are determined. On the basis of the results, the diameters equivalent to those of the circles of the titanium oxide particles present in the unit area are averaged. This average is defined as the circle-equivalent diameter D1 of the titanium oxide particles in the undercoat layer.

In an embodiment of the present invention, the volume ratio of titanium oxide particles represented by formula (1) above is 1.0 or more and 25 or less. In formula (1), (R1×S1) represents the volume amount of zinc oxide particles per unit area as a result of multiplying the average primary particle diameter of the zinc oxide particles by the area ratio of the zinc oxide particles relative to the total area of the zinc oxide particles and the titanium oxide particles per unit area. Similarly, (R2×S2) represents the volume amount of titanium oxide particles per unit area. Accordingly, formula (1) above represents the volume ratio of the titanium oxide particles.

The volume ratio of titanium oxide particles represented by formula (1) is preferably 1.0 or more and 25 or less, and more preferably 5.0 or more and 20 or less. A volume ratio of zinc oxide particles represented by formula (3) below is preferably 75 or more and 99 or less.

$$\frac{R1 \times S1}{R1 \times S1 + R2 \times S2} \times 100 \quad (3)$$

When the volume ratio of titanium oxide particles represented by formula (1) is larger than 25, potential variations due to repeated use easily occur. In contrast, when the volume ratio of titanium oxide particles represented by formula (1) is smaller than 1.0, the effect of masking defects on the support and the effect of suppressing interference fringes are not sufficient.

The area ratio (S1) of the zinc oxide particles or the area ratio (S2) of the titanium oxide particles per unit area in formula (1) is measured as follows.

A cross-sectional photograph of the metal oxide particles whose elements are mapped by an elemental analysis device such as an X-ray microanalyzer (XMA) attached to an SEM is taken. Next, the projected areas of the zinc oxide particles and the titanium oxide particles per unit area (5 μm×5 μm) are measured. The area ratio (S1) of the zinc oxide particles or the area ratio (S2) of the titanium oxide particles per unit area is calculated from the projected area of the zinc oxide particles and the projected area of the titanium oxide particles.

The titanium oxide particles may be titanium oxide particles coated with at least one of alumina and silica. By coating the titanium oxide particles with at least one of alumina and silica, compatibility with a binder resin of the undercoat layer can be improved to enhance the effect of suppressing black spots.

The undercoat layer may contain a binder resin. The binder resin may be any known resin. From the viewpoint that elution in an upper layer during the formation of a photosensitive layer and variations in electrical resistance are suppressed, curable resins are preferable.

Examples of the curable resins include phenolic resins, polyurethane resins, epoxy resins, acrylic resins, melamine resins, and polyester resins. In particular, polyurethane resins formed of a cured product of an isocyanate compound and a polyol are more preferable.

Examples of the isocyanate compound include 2,4-tolylene diisocyanate, 2,6-tolylene diisocyanate, diphenylmethane-4,4'-diisocyanate, hexamethylene diisocyanate (HDI), and products obtained by blocking an HDI-trimethylolpropane adduct, HDI-isocyanurate, HDI-biuret, or the like with an oxime. Examples of the oxime include formaldehyde oxime, acetaldoxime, methyl ethyl ketoxime, and cyclohexanoneoxime. The isocyanate compounds may be blocked isocyanate compounds in which an isocyanate group is blocked.

Examples of the polyol include polyether polyols, polyester polyols, acrylic polyols, epoxy polyols, and fluorine-containing polyols.

The undercoat layer may be formed by applying an undercoat layer-forming coating liquid containing a binder resin, and titanium oxide particles and zinc oxide particles that are subjected to a surface treatment with an organometallic compound or an organosilicon compound to form a coating film, and then drying the coating film.

The undercoat layer-forming coating liquid may be prepared by conducting a dispersion treatment of the zinc oxide particles, the titanium oxide particles, a binder resin, and a solvent. Alternatively, the undercoat layer-forming coating liquid may be prepared by adding a solution containing a binder resin dissolved therein to a dispersion liquid obtained by dispersing the zinc oxide particles and the titanium oxide particles in a solvent, and further performing a dispersion treatment. The dispersion is performed by a method that uses, for example, a homogenizer, an ultrasonic dispersion machine, a ball mill, a sand mill, a roll mill, a vibration mill, an attritor, or a liquid collision-type high-speed dispersion machine.

Examples of the coating method of the undercoat layer include a dip coating method, a spray coating method, a spinner coating method, a bead coating method, a blade coating method, and a beam coating method.

Examples of the drying method include heat drying and air blow drying. The heating temperature may be appropriately determined in consideration of the curing temperature of the resin within a range in which desired characteristics of the electrophotographic photosensitive member are obtained.

Various additives may be further incorporated in the undercoat layer for the purpose of improving electrical characteristics of the undercoat layer, improving film shape stability, improving the image quality, etc.

Examples of the additives include conductive particles such as metal particles, e.g., aluminum particles and copper particles, and carbon black; electron transport materials such as quinone compounds, fluorenone compounds, oxadiazole compounds, diphenoquinone compounds, anthraquinone compounds, benzophenone compounds, polycyclic fused compounds, and azo compounds; and metal chelate compounds. In particular, benzophenone compounds are preferably used because they form a charge-transfer complex as a result of the interaction with metal oxide particles to improve image characteristics.

The solvent used for preparing the undercoat layer-forming coating liquid may be appropriately selected from alcohols, ketones, ethers, esters, halogenated hydrocarbons, and aromatic compounds, etc. For example, methylal, tetrahydrofuran, methanol, ethanol, isopropyl alcohol, butyl alcohol, Methyl Cellosolve, methoxypropanol, acetone, methyl ethyl ketone, cyclohexanone, methyl acetate, ethyl acetate, or dioxane is suitably used. These solvents used in the undercoat layer-forming coating liquid may be used alone or as a mixture of two or more solvents.

The undercoat layer may contain organic resin fine particles and a leveling agent, as required. Examples of the organic resin particles that can be used include hydrophobic organic resin particles such as silicone particles, and hydrophilic organic resin particles such as cross-linked polymethyl methacrylate (PMMA) particles. In particular, PMMA particles are preferable from the viewpoint of adjusting the surface roughness of the undercoat layer to an appropriate range and obtaining a uniform film.

The thickness of the undercoat layer is preferably 0.5 to 40 μm, and more preferably 10 to 30 μm.

Figure 2A:
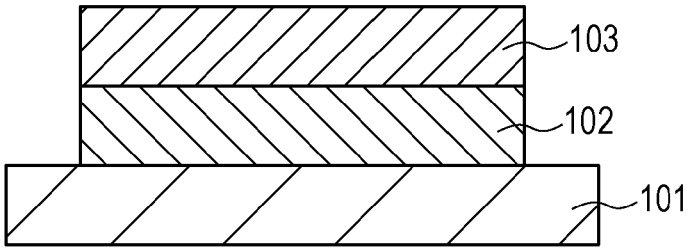
FIGS. 2A and 2B are views illustrating examples of layer structures of an electrophotographic photosensitive member.
Figure 2B:
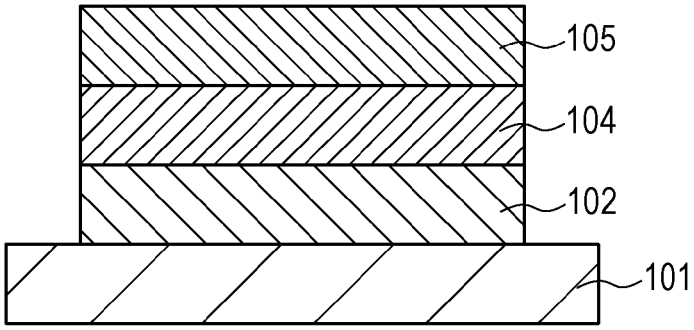

Other structures of an electrophotographic photosensitive member will be described below. FIGS. 2A and 2B illustrate examples of layer structures of the electrophotographic photosensitive member according to an embodiment of the present invention. In FIG. 2A, an undercoat layer 102 is disposed on a support 101, and a photosensitive layer 103 is disposed on the undercoat layer 102. In FIG. 2B, an undercoat layer 102 is disposed on a support 101, a charge generating layer 104 is disposed on the undercoat layer 102, and a charge transporting layer 105 is disposed on the charge generating layer 104.

As described above, the photosensitive layer is classified into a single-layer type photosensitive layer containing both a charge generation material and a charge transport material and a multilayer type photosensitive layer in which a charge generating layer containing a charge generation material and a charge transporting layer containing a charge transport material are stacked. In particular, the multilayer type photosensitive layer is employed.

Support

The support is a support having conductivity (conductive support). For example, a support formed of a metal (or an alloy), e.g., aluminum, an aluminum alloy, or stainless steel may be used. It is also possible to use the above metal support or a plastic support, the metal support or plastic support having a cover layer formed by depositing aluminum, an aluminum alloy, an indium oxide-tin oxide alloy, or the like by vacuum deposition. It is also possible to use a support obtained by impregnating a plastic or paper with conductive particles such as carbon black, tin oxide particles, titanium oxide particles, or silver particles together with a suitable binder resin, or a plastic support including a conductive binder resin. Examples of the shape of the support include a cylindrical shape and a belt shape. A cylindrical shape is preferable.

In order to suppress interference fringes due to scattering of a laser beam, a cutting treatment, a surface-roughening treatment, or an alumite treatment may be performed on the surface of the support.

Intermediate Layer

An intermediate layer may be provided between the undercoat layer and the photosensitive layer in order to further prevent charge injection from the undercoat layer to the photosensitive layer and to improve the flow of charges from the photosensitive layer to the support.

The intermediate layer may be formed by applying an intermediate layer-forming coating liquid containing a resin (binder resin) onto the undercoat layer to form a coating film, and then drying the coating film.

Examples of the resin (binder resin) used for the intermediate layer include polyvinyl alcohol, polyvinyl methyl ether, polyacrylic acids, methyl cellulose, ethyl cellulose, polyglutamic acid, polyamides, polyimides, polyamide-imides, polyamic acid, melamine resins, epoxy resins, polyurethanes, and polyglutamic acid esters.

The intermediate layer preferably has a thickness of 0.1 μm or more and 2 μm or less.

To improve the flow of charges from the photosensitive layer to the support, the intermediate layer may contain a polymer of a composition containing a crosslinking agent and an electron transport material having a reactive functional group (polymerizable functional group). Thus, when the photosensitive layer is formed on the intermediate layer, elution of the material of the intermediate layer to a solvent in a photosensitive layer-forming coating liquid can also be suppressed.

Examples of the electron transport material include quinone compounds, imide compounds, benzimidazole compounds, and cyclopentadienylidene compounds.

Examples of the reactive functional group include a hydroxy group, a thiol group, an amino group, a carboxyl group, and a methoxy group.

In the intermediate layer, the content of the electron transport material having a reactive functional group in the composition is preferably 30% by mass or more and 70% by mass or less.

Charge Generating Layer

The charge generating layer may be formed by applying a charge generating layer-forming coating liquid prepared by dispersing a charge generating material in a solvent together with a binder resin to form a coating film, and then drying the coating film. Alternatively, the charge generating layer may be formed by depositing a charge generating material by vacuum deposition.

Examples of the charge generation material include azo pigments, phthalocyanine pigments, indigo pigments, perylene pigments, polycyclic quinone pigments, squarylium coloring matters, pyrylium salts, thiapyrylium salts, triphenylmethane coloring matters, quinacridone pigments, azulenium salt pigments, cyanine dyes, anthanthrone pigments, pyranthrone pigments, xanthene coloring matters, quinoneimine coloring matters, and styryl coloring matters. These charge generation materials may be used alone or in combination of two or more materials.

Among these charge generation materials, from the viewpoint of sensitivity, phthalocyanine pigments and azo pigments are preferable, and in particular, phthalocyanine pigments are more preferable.

Among phthalocyanine pigments, in particular, oxytitanium phthalocyanine, chlorogallium phthalocyanine, and hydroxygallium phthalocyanine exhibit high charge generation efficiency.

Furthermore, in hydroxygallium phthalocyanine, from the viewpoint of potential characteristics, a hydroxygallium phthalocyanine crystal having peaks at Bragg angles 2θ of 7.4°±0.3° and 28.2°±0.3° in CuKα characteristic X-ray diffraction is more preferable.

When the photosensitive layer is a multilayer type photosensitive layer, examples of the binder resin used in the charge generating layer include acrylic resins, allyl resins, alkyd resins, epoxy resins, diallyl phthalate resins, styrene-butadiene copolymers, butyral resins, benzal resins, polyacrylates, polyacetals, polyamide-imides, polyamides, polyallyl ethers, polyarylates, polyimides, polyurethanes, polyesters, polyethylenes, polycarbonates, polystyrenes, polysulfones, polyvinyl acetals, polybutadienes, polypropylenes, methacrylic resins, urea resins, vinyl chloride-vinyl acetate copolymers, vinyl acetate resins, and vinyl chloride resins. Among these resins, in particular, butyral resins are preferable. These may be used alone or in combination of two or more resins as a mixture or a copolymer.

The charge generating layer may be formed by applying a charge generating layer-forming coating liquid prepared by performing a dispersion treatment of a charge generating material together with a binder resin and a solvent to form a coating film, and then drying the coating film. The dispersion is performed by a method that uses a homogenizer, an ultrasonic dispersion machine, a ball mill, a sand mill, a roll mill, a vibration mill, an attritor, or a liquid collision-type high-speed dispersion machine. The ratio of the charge generation material and the binder resin is preferably in the range of 0.3:1 to 10:1 by mass ratio.

Examples of the solvent used for preparing the charge generating layer-forming coating liquid include alcohols, sulfoxides, ketones, ethers, esters, halogenated aliphatic hydrocarbons, and aromatic compounds.

The thickness of the charge generating layer is preferably 5 μm or less, and in particular, more preferably 0.1 μm or more and 2 μm or less. The charge generating layer may optionally contain a sensitizer, an antioxidant, an ultraviolet absorber, and a plasticizer.

Charge Transporting Layer

When the photosensitive layer is a multilayer type photosensitive layer, the charge transporting layer may be formed by applying a charge transporting layer-forming coating liquid prepared by dissolving a charge transport material and a binder resin in a solvent to form a coating film, and then drying the coating film.

Examples of the charge transport material include triarylamine compounds, hydrazone compounds, styryl compounds, stilbene compounds, and butadiene compounds.

Among these charge transport materials, triarylamine compounds are preferable from the viewpoint of realizing high mobility of charges.

Examples of the binder resin used in the charge transporting layer include acrylic resins, acrylonitrile resins, allyl resins, alkyd resins, epoxy resins, silicone resins, phenolic resins, phenoxy resins, polyacrylamides, polyamide-imides, polyamides, polyallyl ethers, polyarylates, polyimides, polyurethanes, polyesters, polyethylenes, polycarbonates, polysulfones, polyphenylene oxides, polybutadienes, polypropylenes, and methacrylic resins. In particular, polyarylates and polycarbonates are preferable. These resins may be used alone or in combination of two or more resins as a mixture or a copolymer.

The charge transporting layer may be formed by applying a charge transporting layer-forming coating liquid prepared by dissolving a charge transport material and a binder resin in a solvent to form a coating film, and then drying the coating film. The ratio of the charge transport material and the binder resin is preferably in the range of 0.3:1 to 10:1 by mass ratio. From the viewpoint of suppressing cracks, the drying temperature is preferably 60° C. or higher and 150° C. or lower, and in particular, more preferably 80° C. or higher and 120° C. or lower. The drying time is preferably 10 minutes or more and 60 minutes or less.

Examples of the solvent used in the charge transporting layer-forming coating liquid include alcohols (in particular, alcohols having 3 or more carbon atoms), such as propanol and butanol; aromatic hydrocarbons such as anisole, toluene, xylene, and chlorobenzene; methylcyclohexane; and ethylcyclohexane.

The charge transporting layer may have a multilayer structure. In such a case, in order to increase the mechanical strength of the electrophotographic photosensitive member, a charge transporting layer on a surface layer side of the electrophotographic photosensitive member is preferably a layer formed by polymerizing and/or crosslinking a charge transport material having a chain-polymerizable functional group to cure the charge transport material. Examples of the chain-polymerizable functional group include an acryloyloxy group, a methacryloyloxy group, an alkoxysilyl group, and an epoxy group. In order to polymerize and/or crosslink a charge transport material having a chain-polymerizable functional group, heat, light, radiation (such as an electron beam) may be used.

When the charge transporting layer is formed of a single layer, the thickness of the charge transporting layer is preferably 5 μm or more and 40 μm or less, and in particular, more preferably 8 μm or more and 30 μm or less. When the charge transporting layer has a multilayer structure, a charge transporting layer on the support side preferably has a thickness of 5 μm or more and 30 μm or less, and a charge transporting layer on the surface side of the electrophotographic photosensitive member preferably has a thickness of 0.5 μm or more and 10 μm or less.

A charge transporting layer may optionally contain an antioxidant, an ultraviolet absorber, a plasticizer, etc.

The coating liquid for forming each of the above-described layers may be applied by, for example, a dip coating method, a spray coating method, a spinner coating method, a roller coating method, a Meyer bar coating method, or a blade coating method.

A layer (surface layer) on the outermost surface of the electrophotographic photosensitive member may contain a lubricant such as silicon oil, wax, polytetrafluoroethylene particles, silica particles, alumina particles, or boron nitride.

FIG. 1 illustrates an example of the schematic structure of an electrophotographic apparatus that includes a process cartridge including an electrophotographic photosensitive member.

In FIG. 1, a cylindrical electrophotographic photosensitive member 1 is rotated about a shaft 2 at a predetermined peripheral speed in the direction indicated by the arrow.

The peripheral surface of the rotated electrophotographic photosensitive member 1 is uniformly charged at a predetermined positive or negative potential by a charging device (such as a charging roller) 3.

Subsequently, the electrophotographic photosensitive member 1 receives exposure light (image exposure light) 4 emitted from an exposure device (image exposure device, not illustrated) such as a slit exposure device or a laser beam scanning exposure device. Thus, electrostatic latent images corresponding to intended images are sequentially formed on the peripheral surface of the electrophotographic photosensitive member 1. The voltage applied to the charging device 3 may be a direct-current voltage alone or a direct-current voltage on which an alternating voltage is superimposed.

The electrostatic latent images formed on the peripheral surface of the electrophotographic photosensitive member 1 are developed with a toner of a developing device 5 to form toner images. Subsequently, the toner images formed on the peripheral surface of the electrophotographic photosensitive member 1 are transferred onto a transfer material (e.g., paper) P by a transfer bias from a transfer device (e.g., transfer roller) 6. The transfer material P is fed to a portion (contact portion) between the electrophotographic photosensitive member 1 and the transfer device 6 from a transfer material feeding device (not illustrated) in synchronism with the rotation of the electrophotographic photosensitive member 1.

The transfer material P onto which the toner images have been transferred is separated from the peripheral surface of the electrophotographic photosensitive member 1 and is conveyed to a fixing device 8. After a toner image is fixed, the transfer material P is output to the outside of the electrophotographic apparatus as an image-formed article (a print or a copy).

The peripheral surface of the electrophotographic photosensitive member 1 after the toner images have been transferred is subjected to removal of a residual toner with a cleaning device (e.g., cleaning blade) 7. Recently, a cleanerless system has also been developed, and a residual toner remaining after transfer can be removed either directly or using a developing device or the like. The peripheral surface of the electrophotographic photosensitive member 1 after the toner images have been transferred is irradiated with pre-exposure light emitted from a pre-exposure device (not illustrated) to remove electricity, and then the electrophotographic photosensitive member 1 is repeatedly used for image formation. In the case where the charging device is a contact charging device, the pre-exposure is not essential.

Among the components selected from the electrophotographic photosensitive member 1, the charging device 3, the developing device 5, the transfer device 6, the cleaning device 7, etc., a plurality of components may be selected and housed in a case to integrally combine in the form of a process cartridge. The process cartridge may be configured to be detachably attachable to a main body of an electrophotographic apparatus. In FIG. 1, the electrophotographic photosensitive member 1, the charging device 3, the developing device 5, and the cleaning device 7 are integrally supported to constitute a process cartridge 9. The process cartridge 9 is detachably attachable to a main body of the electrophotographic apparatus using a guiding device 10 such as a rail of the main body of the electrophotographic apparatus.

EXAMPLES

The present invention will be described more specifically using Examples, but is not limited thereto. In Examples, "%" and "part" refer to "% by mass" and "part by mass", respectively.

Example 1

An aluminum cylinder (JIS-A3003, aluminum alloy, length: 357.5 mm) having a diameter of 30 mm was used as a support (conductive support).

Next, 100 parts of zinc oxide particles (average primary particle diameter: 50 nm, specific surface area (hereinafter referred to as "BET value"): 19 $m^2/g$, powder resistivity: $1.0\times10^7$ Ω·cm) were mixed with 500 parts of toluene under stirring. Subsequently, 0.75 parts of an organosilicon compound was added thereto, and the resulting mixture was stirred for two hours. Toluene was then removed by distillation under reduced pressure, and baking was performed at 120° C. for three hours to obtain surface-treated zinc oxide particles M1. N-2-(Aminoethyl)-3-aminopropylmethyldimethoxysilane (trade name: KBM602, manufactured by Shin-Etsu Chemical Co., Ltd.) was used as the organosilicon compound.

One hundred parts of titanium oxide particles (JR-405, manufactured by TAYCA Corporation, average primary particle diameter: 210 nm) were mixed with 500 parts of toluene under stirring. Subsequently, 0.75 parts of N-2-(aminoethyl)-3-aminopropylmethyldimethoxysilane was added thereto, and the resulting mixture was stirred for two hours. Toluene was then removed by distillation under reduced pressure, and baking was performed at 120° C. for three hours to obtain surface-treated titanium oxide particles N1.

Next, 15 parts of a polyvinyl acetal resin (trade name: BM-1, manufactured by Sekisui Chemical Co., Ltd.) and 30 parts of a blocked isocyanate (trade name: Sumidur 3175, manufactured by Sumika Bayer Urethane Co., Ltd.) were dissolved in a mixed solvent of 70 parts of methyl ethyl ketone and 70 parts of 1-butanol to prepare a solution. To this solution, 100 parts of the surface-treated zinc oxide particles M1, 12 parts of the surface-treated titanium oxide particles N1, and 1 part of 2,3,4-trihydroxybenzophenone (manufactured by Tokyo Chemical Industry Co., Ltd.) were added. The resulting mixture was dispersed in an atmosphere at 23° C.±3° C. for three hours in a sand mill that used glass beads having a diameter of 1 mm. After the dispersion, 7 parts of cross-linked polymethyl methacrylate particles (SSX-103, manufactured by Sekisui Plastics Co., Ltd.) serving as resin particles and 0.01 parts of silicone oil SH28PA (manufactured by Dow Corning Toray Silicone Co., Ltd.) were added thereto and stirred to prepare an undercoat layer-forming coating liquid.

The prepared undercoat layer-forming coating liquid was applied onto the support by dip coating to form a coating film. The coating film was dried at 160° C. for 20 minutes to form an undercoat layer having a thickness of 30 μm.

Next, a hydroxygallium phthalocyanine crystal (charge generation material) having peaks at Bragg angles (2θ±0.2°) of 7.5°, 9.9°, 12.5°, 16.3°, 18.6°, 25.1°, and 28.3° in CuKα characteristic X-ray diffraction were prepared. Subsequently, 10 parts of this hydroxygallium phthalocyanine crystal, 0.1 parts of a compound represented by chemical formula (1) below, 5 parts of polyvinyl butyral (trade name: S-LEC BX-1, manufactured by Sekisui Chemical Co., Ltd.), and 250 parts of cyclohexanone were charged in a sand mill that used glass beads having a diameter of 0.8 mm, and dispersed for 1.5 hours. Next, 250 parts of ethyl acetate was added thereto and thus a charge generating layer-forming coating liquid was prepared.

(1)

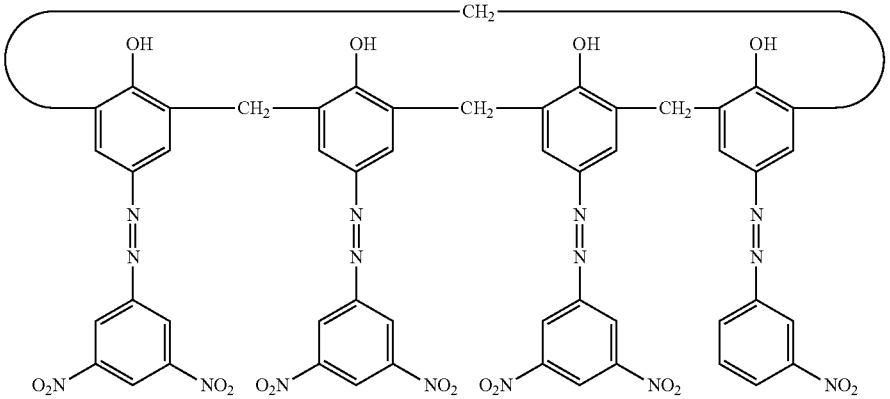

The charge generating layer-forming coating liquid was applied onto the undercoat layer by dip coating to form a coating film. The coating film was dried at 100° C. for 10 minutes to form a charge generating layer having a thickness of 0.15 μm.

Next, 4 parts of a compound (charge transport material) represented by chemical formula (2-1) below, 4 parts of a compound (charge transport material) represented by chemical formula (2-2) below, and 10 parts of a bisphenol Z-type polycarbonate (trade name: 2400, manufactured by Mitsubishi Engineering-Plastics Corporation) were dissolved in a mixed solvent of 40 parts of dimethoxymethane and 60 parts of chlorobenzene to prepare a charge transporting layer-forming coating liquid. The charge transporting layer-forming coating liquid was applied onto the charge generating layer by dip coating to form a coating film. The coating film was dried at 120° C. for 40 minutes to form a charge transporting layer having a thickness of 15 μm.

(2-1)

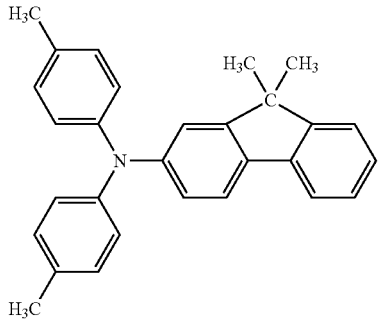

(2-2)

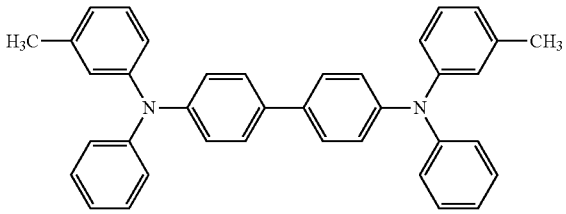

Thus, an electrophotographic photosensitive member including a support, an undercoat layer, a charge generating layer, and a charge transporting layer was produced.

The electrophotographic photosensitive member for evaluation, the electrophotographic photosensitive member being produced as described above, was installed in a modified laser beam printer (trade name: LBP-2510) manufactured by CANON KABUSHIKI KAISHA and evaluated. The details of the modified point are as follows. Charging conditions and the amount of laser exposure were determined so that, regarding the surface potential of the electrophotographic photosensitive member, an initial dark-area potential became −600 V and an initial light-area (exposed area) potential became −150 V in an environment at a temperature of 35° C. and a humidity of 85% RH. The measurement of the surface potential was performed as follows. A cartridge was modified, and a potential probe (trade name: model 6000B-8, manufactured by TREK Japan K.K.) was attached at a developing position. The potential of a central portion of the electrophotographic photosensitive member was measured using a surface electrometer (trade name: model 344, manufactured by TREK Japan K.K.).

Black Spot Evaluation

Black spots were evaluated as follows. A white solid image was output over a surface of A4 gloss paper. The number of black spots included in an area of the output image, the area corresponding to one perimeter of the electrophotographic photosensitive member, was evaluated by visual observation on the basis of the following criteria. The "area corresponding to one perimeter of the electrophotographic photosensitive member" refers to a rectangular area having a length of 297 mm, which is the length of the long side of an A4 sheet, and a width of 94.2 mm, which corresponds to one perimeter of the electrophotographic photosensitive member. Table 1 shows the evaluation results.

A: No black spots are observed.

B: One to three black spots having a diameter of more than 0.3 mm are observed.

C: Four to six black spots having a diameter of more than 0.3 mm are observed.

D: Seven to nine black spots having a diameter of more than 0.3 mm are observed.

E: Ten or more black spots having a diameter of more than 0.3 mm are observed.

Potential Variation Evaluation

In the evaluation of potential variation, a text image was printed on A4 plain paper at a printing ratio of a cyan single color of 1%. This image formation was repeatedly performed on 10,000 sheets. At this time, an initial light-area potential and a light-area potential after the image formation was repeatedly performed on 10,000 sheets were compared. This difference is defined as a potential variation value (ΔV1). Table 1 shows the evaluation results.

Interference Fringe Evaluation

As in the evaluation of potential variation, after the image formation was repeatedly performed on 10,000 sheets, a half-tone image of a monochrome Keima pattern (spaced checkerboard pattern) was output on A4 plain paper. Thus, interference fringes after the image formation was repeatedly performed were evaluated. Interference fringes were evaluated on the basis of the following criteria. Table 1 shows the evaluation results.

A: No interference fringes are observed, and thus the results are good.

B: Interference fringes are not substantially observed, and thus the results are good.

C: Interference fringes are generated.

The average primary particle diameter (R1) of zinc oxide particles, the average primary particle diameter (R2) of titanium oxide particles, the area ratio (S1) of zinc oxide particles, the area ratio (S2) of titanium oxide particles, and the circle-equivalent diameter (D1) of titanium oxide particles in the undercoat layer were measured by the methods described above. The values represented by formulae (1) and (2) were calculated.

Example 2

One hundred parts of titanium oxide particles (trade name: PT-401L, manufactured by Ishihara Sangyo Kaisha, Ltd., average primary particle diameter: 130 nm) were mixed with 500 parts of toluene under stirring. Subsequently, 0.75 parts of N-2-(aminoethyl)-3-aminopropylmethyldimethoxysilane was added thereto, and the resulting mixture was stirred for two hours. Toluene was then removed by distillation under reduced pressure, and baking was performed at 120° C. for three hours to obtain surface-treated titanium oxide particles N2.

An electrophotographic photosensitive member was produced and evaluated as in Example 1 except that, in the preparation of the undercoat layer-forming coating liquid, the titanium oxide particles N1 were changed to the titanium oxide particles N2.

Example 3

One hundred parts of titanium oxide particles (trade name: TA-300, manufactured by Fuji Titanium Industry Co., Ltd., average primary particle diameter: 590 nm) were mixed with 500 parts of toluene under stirring. Subsequently, 0.75 parts of N-2-(aminoethyl)-3-aminopropylmethyldimethoxysilane was added thereto, and the resulting mixture was stirred for two hours. Toluene was then removed by distillation under reduced pressure, and baking was performed at 120° C. for three hours to obtain surface-treated titanium oxide particles N3.

An electrophotographic photosensitive member was produced and evaluated as in Example 1 except that, in the preparation of the undercoat layer-forming coating liquid, the titanium oxide particles N1 were changed to the titanium oxide particles N3.

Example 4

One hundred parts of titanium oxide particles (JR-405, manufactured by TAYCA Corporation, average primary particle diameter: 210 nm) were mixed with 500 parts of toluene under stirring. Subsequently, 0.75 parts of N-2-(aminoethyl)-3-aminopropyltrimethoxysilane (trade name: KBM603, manufactured by Shin-Etsu Chemical Co., Ltd.) was added thereto, and the resulting mixture was stirred for two hours. Toluene was then removed by distillation under reduced pressure, and baking was performed at 120° C. for three hours to obtain surface-treated titanium oxide particles N4.

An electrophotographic photosensitive member was produced and evaluated as in Example 1 except that, in the preparation of the undercoat layer-forming coating liquid, the titanium oxide particles N1 were changed to the titanium oxide particles N4.

Example 5

One hundred parts of titanium oxide particles (JR-405, manufactured by TAYCA Corporation, average primary particle diameter: 210 nm) were mixed with 500 parts of toluene under stirring. Subsequently, 1 part of diisopropoxy titanium bis(acetylacetonate) (trade name: ORGATIX TC-100, manufactured by Matsumoto Fine Chemical Co., Ltd.) was added thereto, and the resulting mixture was stirred for two hours. Toluene was then removed by distillation under reduced pressure, and baking was performed at 120° C. for three hours to obtain surface-treated titanium oxide particles N5.

An electrophotographic photosensitive member was produced and evaluated as in Example 1 except that, in the preparation of the undercoat layer-forming coating liquid, the titanium oxide particles N1 were changed to the titanium oxide particles N5.

Example 6

One hundred parts of titanium oxide particles (JR-405, manufactured by TAYCA Corporation, average primary particle diameter: 210 nm) were mixed with 500 parts of toluene under stirring. Subsequently, 0.75 parts of 3-methacryloxypropylmethyldimethoxysilane (trade name: KBM502, manufactured by Shin-Etsu Chemical Co., Ltd.) was added thereto, and the resulting mixture was stirred for two hours. Toluene was then removed by distillation under reduced pressure, and baking was performed at 120° C. for three hours to obtain surface-treated titanium oxide particles N6.

An electrophotographic photosensitive member was produced and evaluated as in Example 1 except that, in the preparation of the undercoat layer-forming coating liquid, the titanium oxide particles N1 were changed to the titanium oxide particles N6.

Example 7

An electrophotographic photosensitive member was produced and evaluated as in Example 1 except that, in the preparation of the undercoat layer-forming coating liquid, the amount of surface-treated zinc oxide particles M1 was changed to 111 parts, and the amount of surface-treated titanium oxide particles N1 was changed to 1 part.

Example 8

An electrophotographic photosensitive member was produced and evaluated as in Example 1 except that, in the preparation of the undercoat layer-forming coating liquid, the amount of surface-treated zinc oxide particles M1 was changed to 107.5 parts, and the amount of surface-treated titanium oxide particles N1 was changed to 4.5 parts.

Example 9

An electrophotographic photosensitive member was produced and evaluated as in Example 1 except that, in the preparation of the undercoat layer-forming coating liquid, the amount of surface-treated zinc oxide particles M1 was changed to 104 parts, and the amount of surface-treated titanium oxide particles N1 was changed to 8 parts.

Example 10

An electrophotographic photosensitive member was produced and evaluated as in Example 1 except that, in the preparation of the undercoat layer-forming coating liquid, the amount of surface-treated zinc oxide particles M1 was changed to 95 parts, and the amount of surface-treated titanium oxide particles N1 was changed to 17 parts.

Example 11

An electrophotographic photosensitive member was produced and evaluated as in Example 1 except that, in the preparation of the undercoat layer-forming coating liquid, the amount of surface-treated zinc oxide particles M1 was changed to 90.5 parts, and the amount of surface-treated titanium oxide particles N1 was changed to 21.5 parts.

Example 12

One hundred parts of zinc oxide particles (average primary particle diameter: 50 nm, BET value: 19 $m^2/g$, powder resistivity: $3.7\times10^3$ Ω·cm) were mixed with 500 parts of toluene under stirring. Subsequently, 0.75 parts of N-2-(aminoethyl)-3-aminopropyltrimethoxysilane was added thereto, and the resulting mixture was stirred for two hours. Toluene was then removed by distillation under reduced pressure, and baking was performed at 120° C. for three hours to obtain surface-treated zinc oxide particles M2.

An electrophotographic photosensitive member was produced and evaluated as in Example 1 except that, in the preparation of the undercoat layer-forming coating liquid, the zinc oxide particles M1 were changed to the zinc oxide particles M2.

Example 13

One hundred parts of zinc oxide particles (average primary particle diameter: 50 nm, BET value: 19 $m^2/g$, powder resistivity: $3.7\times10^3$ Ω·cm) were mixed with 500 parts of toluene under stirring. Subsequently, 1 part of diisopropoxy titanium bis(acetylacetonate) was added thereto, and the resulting mixture was stirred for two hours. Toluene was then removed by distillation under reduced pressure, and baking was performed at 120° C. for three hours to obtain surface-treated zinc oxide particles M3.

An electrophotographic photosensitive member was produced and evaluated as in Example 1 except that, in the preparation of the undercoat layer-forming coating liquid, the zinc oxide particles M1 were changed to the zinc oxide particles M3.

Example 14

One hundred parts of zinc oxide particles (average primary particle diameter: 50 nm, BET value: 19 $m^2/g$, powder resistivity: $3.7\times10^3$ Ω·cm) were mixed with 500 parts of toluene under stirring. Subsequently, 0.75 parts of 3-methacryloxypropylmethyldimethoxysilane was added thereto, and the resulting mixture was stirred for two hours. Toluene was then removed by distillation under reduced pressure, and baking was performed at 120° C. for three hours to obtain surface-treated zinc oxide particles M4.

An electrophotographic photosensitive member was produced and evaluated as in Example 1 except that, in the preparation of the undercoat layer-forming coating liquid, the zinc oxide particles M1 were changed to the zinc oxide particles M4.

Example 15

One hundred parts of zinc oxide particles (average primary particle diameter: 10 nm, BET value: 95 $m^2/g$, powder resistivity: $3.7\times10^3$ Ω·cm) were mixed with 500 parts of toluene under stirring. Subsequently, 1.25 parts of N-2-(aminoethyl)-3-aminopropylmethyldimethoxysilane was added thereto, and the resulting mixture was stirred for two hours. Toluene was then removed by distillation under reduced pressure, and baking was performed at 120° C. for three hours to obtain surface-treated zinc oxide particles M5.

An electrophotographic photosensitive member was produced and evaluated as in Example 1 except that, in the preparation of the undercoat layer-forming coating liquid, the zinc oxide particles M1 were changed to the zinc oxide particles M5.

Example 16

One hundred parts of zinc oxide particles (trade name: FZO-50, manufactured by Ishihara Sangyo Kaisha, Ltd., average primary particle diameter: 20 nm) were mixed with 500 parts of toluene under stirring. Subsequently, 1.25 parts of N-2-(aminoethyl)-3-aminopropylmethyldimethoxysilane was added thereto, and the resulting mixture was stirred for two hours. Toluene was then removed by distillation under reduced pressure, and baking was performed at 120° C. for three hours to obtain surface-treated zinc oxide particles M6.

An electrophotographic photosensitive member was produced and evaluated as in Example 1 except that, in the preparation of the undercoat layer-forming coating liquid, the zinc oxide particles M1 were changed to the zinc oxide particles M6.

Example 17

One hundred parts of zinc oxide particles (trade name: Zincox Super F-2, manufactured by HakusuiTech Co., Ltd., average primary particle diameter: 65 nm) were mixed with 500 parts of toluene under stirring. Subsequently, 1.25 parts of N-2-(aminoethyl)-3-aminopropylmethyldimethoxysilane was added thereto, and the resulting mixture was stirred for two hours. Toluene was then removed by distillation under reduced pressure, and baking was performed at 120° C. for three hours to obtain surface-treated zinc oxide particles M7.

An electrophotographic photosensitive member was produced and evaluated as in Example 1 except that, in the preparation of the undercoat layer-forming coating liquid, the zinc oxide particles M1 were changed to the zinc oxide particles M7.

Example 18

One hundred parts of zinc oxide particles (trade name: Zincox Super F-2, manufactured by HakusuiTech Co., Ltd., average primary particle diameter: 100 nm) were mixed with 500 parts of toluene under stirring. Subsequently, 1.25 parts of N-2-(aminoethyl)-3-aminopropylmethyldimethoxysilane was added thereto, and the resulting mixture was stirred for two hours. Toluene was then removed by distillation under reduced pressure, and baking was performed at 120° C. for three hours to obtain surface-treated zinc oxide particles M8.

An electrophotographic photosensitive member was produced and evaluated as in Example 1 except that, in the preparation of the undercoat layer-forming coating liquid, the zinc oxide particles M1 were changed to the zinc oxide particles M8.

Example 19

One hundred parts of titanium oxide particles (JR-405, manufactured by TAYCA Corporation, average primary particle diameter: 210 nm) were mixed with 500 parts of toluene under stirring. Subsequently, 1.25 parts of N-2-(aminoethyl)-3-aminopropylmethyldimethoxysilane was added thereto, and the resulting mixture was stirred for two hours. Toluene was then removed by distillation under reduced pressure, and baking was performed at 120° C. for three hours to obtain surface-treated titanium oxide particles N7.

An electrophotographic photosensitive member was produced and evaluated as in Example 1 except that, in the preparation of the undercoat layer-forming coating liquid, the titanium oxide particles N1 were changed to the titanium oxide particles N7.

TABLE 1

| | Black spot evaluation | Potential variation evaluation | Interference fringe evaluation | R1 | R2 | S1 | S2 | D1 | Formula (1) | Formula (2) |
|---|---|---|---|---|---|---|---|---|---|---|
| Example 1 | A | 7 | A | 50 | 210 | 96.3 | 3.7 | 221 | 13.9 | 1.05 |
| Example 2 | A | 7 | A | 50 | 130 | 94.1 | 5.9 | 139 | 14.0 | 1.07 |
| Example 3 | B | 9 | A | 50 | 590 | 98.7 | 1.3 | 625 | 13.5 | 1.06 |
| Example 4 | A | 7 | A | 50 | 210 | 96.3 | 3.7 | 227 | 13.9 | 1.08 |
| Example 5 | B | 11 | A | 50 | 210 | 96.5 | 3.5 | 250 | 13.2 | 1.19 |
| Example 6 | A | 9 | A | 50 | 210 | 96.4 | 3.6 | 239 | 13.6 | 1.14 |

TABLE 1-continued

| | Black spot evaluation | Potential variation evaluation | Interference fringe evaluation | R1 | R2 | S1 | S2 | D1 | Formula (1) | Formula (2) |
|---|---|---|---|---|---|---|---|---|---|---|
| Example 7 | A | 5 | B | 50 | 210 | 99.7 | 0.3 | 218 | 1.2 | 1.04 |
| Example 8 | A | 6 | A | 50 | 210 | 98.7 | 1.3 | 219 | 5.2 | 1.04 |
| Example 9 | A | 7 | A | 50 | 210 | 97.6 | 2.4 | 223 | 9.4 | 1.06 |
| Example 10 | B | 10 | A | 50 | 210 | 94.5 | 5.5 | 225 | 19.6 | 1.07 |
| Example 11 | B | 16 | A | 50 | 210 | 92.8 | 7.2 | 229 | 24.6 | 1.09 |
| Example 12 | A | 7 | A | 50 | 210 | 96.3 | 3.7 | 224 | 13.9 | 1.07 |
| Example 13 | B | 14 | A | 50 | 210 | 96.1 | 3.9 | 241 | 14.6 | 1.15 |
| Example 14 | A | 11 | A | 50 | 210 | 96.2 | 3.8 | 231 | 14.2 | 1.10 |
| Example 15 | B | 13 | A | 10 | 210 | 99.2 | 0.8 | 237 | 14.5 | 1.13 |
| Example 16 | A | 10 | A | 20 | 210 | 98.5 | 1.5 | 222 | 13.8 | 1.06 |
| Example 17 | A | 9 | A | 65 | 210 | 95.2 | 4.8 | 220 | 14.0 | 1.05 |
| Example 18 | A | 12 | A | 100 | 210 | 92.7 | 7.3 | 228 | 14.2 | 1.09 |
| Example 19 | B | 9 | A | 50 | 210 | 96.2 | 3.8 | 225 | 14.2 | 1.07 |

Comparative Example 1

One hundred parts of titanium oxide particles (trade name: MT700B, manufactured by TAYCA Corporation, average primary particle diameter: 80 nm) were mixed with 500 parts of toluene under stirring. Subsequently, 0.75 parts of N-2-(aminoethyl)-3-aminopropylmethyldimethoxysilane was added thereto, and the resulting mixture was stirred for two hours. Toluene was then removed by distillation under reduced pressure, and baking was performed at 120° C. for three hours to obtain surface-treated titanium oxide particles N8.

An electrophotographic photosensitive member was produced and evaluated as in Example 1 except that, in the preparation of the undercoat layer-forming coating liquid, the titanium oxide particles N1 were changed to the titanium oxide particles N8.

Comparative Example 2

One hundred parts of titanium oxide particles (trade name: TA-500, manufactured by Fuji Titanium Industry Co., Ltd., average primary particle diameter: 680 nm) were mixed with 500 parts of toluene under stirring. Subsequently, 0.75 parts of N-2-(aminoethyl)-3-aminopropylmethyldimethoxysilane was added thereto, and the resulting mixture was stirred for two hours. Toluene was then removed by distillation under reduced pressure, and baking was performed at 120° C. for three hours to obtain surface-treated titanium oxide particles N9.

An electrophotographic photosensitive member was produced and evaluated as in Example 1 except that, in the preparation of the undercoat layer-forming coating liquid, the titanium oxide particles N1 were changed to the titanium oxide particles N9.

Comparative Example 3

An electrophotographic photosensitive member was produced and evaluated as in Example 1 except that, in the preparation of the undercoat layer-forming coating liquid, the amount of surface-treated zinc oxide particles M1 was changed to 111.5 parts, and the amount of surface-treated titanium oxide particles N1 was changed to 0.5 parts.

Comparative Example 4

An electrophotographic photosensitive member was produced and evaluated as in Example 1 except that, in the preparation of the undercoat layer-forming coating liquid, the amount of surface-treated zinc oxide particles M1 was changed to 85 parts, and the amount of surface-treated titanium oxide particles N1 was changed to 27 parts.

Comparative Example 5

An electrophotographic photosensitive member was produced and evaluated as in Example 1 except the following. In the preparation of the undercoat layer-forming coating liquid, the zinc oxide particles M1 were changed to zinc oxide particles (average primary particle diameter: 50 nm, BET value: 19 $m^2/g$, powder resistivity: $3.7\times10^3$ Ω·cm). Furthermore, the titanium oxide particles N1 were changed to titanium oxide particles (JR-405, manufactured by TAYCA Corporation, number-average primary particle diameter: 210 nm). The zinc oxide particles and the titanium oxide particles used in Comparative Example 5 are particles that are not subjected to a surface treatment with an organometallic compound or an organosilicon compound.

Comparative Example 6

An electrophotographic photosensitive member was produced and evaluated as in Example 1 except that, in the preparation of the undercoat layer-forming coating liquid, the zinc oxide particles M1 were changed to zinc oxide particles (average primary particle diameter: 50 nm, BET value: 19 $m^2/g$, powder resistivity: $3.7\times10^3$ Ω·cm). The zinc oxide particles used in Comparative Example 6 are particles that are not subjected to a surface treatment with an organometallic compound or an organosilicon compound.

Comparative Example 7

An electrophotographic photosensitive member was produced and evaluated as in Example 1 except that, in the preparation of the undercoat layer-forming coating liquid, the titanium oxide particles N1 were changed were changed to titanium oxide particles (JR-405, manufactured by TAYCA Corporation, average primary particle diameter: 210 nm). The titanium oxide particles used in Comparative Example 7 are particles that are not subjected to a surface treatment with an organometallic compound or an organosilicon compound.

TABLE 2

| | Black spot evaluation | Potential variation evaluation | Interference fringe evaluation | R1 | R2 | S1 | S2 | D1 | Formula (1) | Formula (2) |
|---|---|---|---|---|---|---|---|---|---|---|
| Com. Ex. 1 | B | 7 | C | 50 | 80 | 90.9 | 9.1 | 86 | 13.8 | 1.08 |
| Com. Ex. 2 | D | 12 | A | 50 | 680 | 98.9 | 1.1 | 728 | 13.1 | 1.07 |
| Com. Ex. 3 | A | 7 | C | 50 | 210 | 99.8 | 0.2 | 218 | 0.8 | 1.04 |
| Com. Ex. 4 | C | 25 | A | 50 | 210 | 90.6 | 9.4 | 233 | 30.4 | 1.11 |
| Com. Ex. 5 | E | 28 | C | 50 | 210 | 96.3 | 3.7 | 294 | 13.9 | 1.40 |
| Com. Ex. 6 | D | 26 | B | 50 | 210 | 95.7 | 4.3 | 263 | 15.9 | 1.25 |
| Com. Ex. 7 | D | 17 | C | 50 | 210 | 96.6 | 3.4 | 273 | 12.9 | 1.30 |

Com. Ex.: Comparative Example

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-242597, filed Nov. 28, 2014, which is hereby incorporated by reference herein in its entirety.

What is claimed is:

1. An electrophotographic photosensitive member comprising:

a support;

an undercoat layer on the support; and a photosensitive layer on the undercoat layer, wherein the undercoat layer contains zinc oxide particles subjected to a surface treatment with an organometallic compound or an organosilicon compound and titanium oxide particles subjected to a surface treatment with an organometallic compound or an organosilicon compound, the titanium oxide particles have an average primary particle diameter of 100 nm or more and 600 nm or less, and a volume ratio of the titanium oxide particles represented by formula (1) is 1.0 or more and 25 or less:

$$\frac{R2 \times S2}{R1 \times S1 + R2 \times S2} \times 100 \quad (1)$$

where, in formula (1), R1 represents an average primary particle diameter of the zinc oxide particles, R2 represents an average primary particle diameter of the titanium oxide particles, S1 represents an area ratio of the zinc oxide particles relative to a total area of the zinc oxide particles and the titanium oxide particles per unit area of the undercoat layer, and S2 represents an area ratio of the titanium oxide particles relative to the total area of the zinc oxide particles and the titanium oxide particles per unit area of the undercoat layer.

2. The electrophotographic photosensitive member according to claim 1, wherein the volume ratio of the titanium oxide particles represented by formula (1) is 5.0 or more and 20 or less.

3. The electrophotographic photosensitive member according to claim 1, wherein the zinc oxide particles are zinc oxide particles subjected to a surface treatment with an organosilicon compound, and the titanium oxide particles are titanium oxide particles subjected to a surface treatment with an organosilicon compound.

4. The electrophotographic photosensitive member according to claim 1, wherein the organosilicon compound has an amino group.

5. The electrophotographic photosensitive member according to claim 1, wherein the average primary particle diameter (R1) of the zinc oxide particles is 20 nm or more and 80 nm or less.

6. The electrophotographic photosensitive member according to claim 1, wherein the titanium oxide particles are coated with at least one of alumina and silica.

7. A method for producing an electrophotographic photosensitive member that includes a support, an undercoat layer on the support, and a photosensitive layer on the undercoat layer, the undercoat layer containing zinc oxide particles subjected to a surface treatment with an organometallic compound or an organosilicon compound and titanium oxide particles subjected to a surface treatment with an organometallic compound or an organosilicon compound, the titanium oxide particles having an average primary particle diameter of 100 nm or more and 600 nm or less, and a volume ratio of the titanium oxide particles represented by formula (1) being 1.0 or more and 25 or less, the method comprising the steps of:

preparing an undercoat layer-forming coating liquid containing the zinc oxide particles and the titanium oxide particles;

forming a coating film of the undercoat layer-forming coating liquid; and forming an undercoat layer by drying the coating film:

$$\frac{R2 \times S2}{R1 \times S1 + R2 \times S2} \times 100 \quad (1)$$

where, in formula (1), R1 represents an average primary particle diameter of the zinc oxide particles, R2 represents an average primary particle diameter of the titanium oxide particles, S1 represents an area ratio of the zinc oxide particles relative to a total area of the zinc oxide particles and the titanium oxide particles per unit area of the undercoat layer, and S2 represents an area ratio of the titanium oxide particles relative to the total area of the zinc oxide particles and the titanium oxide particles per unit area of the undercoat layer.

8. A process cartridge detachably attachable to a main body of an electrophotographic apparatus, the process cartridge comprising:

an electrophotographic photosensitive member including a support, an undercoat layer on the support, and a photosensitive layer on the undercoat layer; and at least one device selected from the group consisting of a charging device, a developing device, and a cleaning device, the electrophotographic photosensitive member and the at least one device being integrally supported, wherein the undercoat layer of the electrophotographic photosensitive member contains zinc oxide particles subjected to a surface treatment with an organometallic compound or an organosilicon compound and titanium oxide particles subjected to a surface treatment with an organometallic compound or an organosilicon compound, the titanium oxide particles have an average primary particle diameter of 100 nm or more and 600 nm or less, and a volume ratio of the titanium oxide particles represented by formula (1) is 1.0 or more and 25 or less:

$$\frac{R2 \times S2}{R1 \times S1 + R2 \times S2} \times 100 \quad (1)$$

where, in formula (1), R1 represents an average primary particle diameter of the zinc oxide particles, R2 represents an average primary particle diameter of the titanium oxide particles, S1 represents an area ratio of the zinc oxide particles relative to a total area of the zinc oxide particles and the titanium oxide particles per unit area of the undercoat layer, and S2 represents an area ratio of the titanium oxide particles relative to the total area of the zinc oxide particles and the titanium oxide particles per unit area of the undercoat layer.

9. An electrophotographic apparatus comprising:

an electrophotographic photosensitive member including a support, an undercoat layer on the support, and a photosensitive layer on the undercoat layer;

a charging device;

an exposure device;

a developing device; and a transfer device, wherein the undercoat layer of the electrophotographic photosensitive member contains zinc oxide particles subjected to a surface treatment with an organometallic compound or an organosilicon compound and titanium oxide particles subjected to a surface treatment with an organometallic compound or an organosilicon compound, the titanium oxide particles have an average primary particle diameter of 100 nm or more and 600 nm or less, and a volume ratio of the titanium oxide particles represented by formula (1) is 1.0 or more and 25 or less:

$$\frac{R2 \times S2}{R1 \times S1 + R2 \times S2} \times 100 \quad (1)$$

where, in formula (1), R1 represents an average primary particle diameter of the zinc oxide particles, R2 represents an average primary particle diameter of the titanium oxide particles, S1 represents an area ratio of the zinc oxide particles relative to a total area of the zinc oxide particles and the titanium oxide particles per unit area of the undercoat layer, and S2 represents an area ratio of the titanium oxide particles relative to the total area of the zinc oxide particles and the titanium oxide particles per unit area of the undercoat layer.

10. An electrophotographic photosensitive member comprising:

a support;

an undercoat layer on the support; and a photosensitive layer on the undercoat layer, wherein the undercoat layer contains zinc oxide particles subjected to a surface treatment with an organometallic compound or an organosilicon compound and titanium oxide particles, the titanium oxide particles have an average primary particle diameter of 100 nm or more and 600 nm or less, a volume ratio of the titanium oxide particles represented by formula (1) is 1.0 or more and 25 or less:

$$\frac{R2 \times S2}{R1 \times S1 + R2 \times S2} \times 100 \quad (1)$$

(where, in formula (1), R1 represents an average primary particle diameter of the zinc oxide particles, R2 represents an average primary particle diameter of the titanium oxide particles, S1 represents an area ratio of the zinc oxide particles relative to a total area of the zinc oxide particles and the titanium oxide particles per unit area of the undercoat layer, and S2 represents an area ratio of the titanium oxide particles relative to the total area of the zinc oxide particles and the titanium oxide particles per unit area of the undercoat layer), and the titanium oxide particles satisfy formula (2):

$$D1/R2 \leq 1.2 \quad (2)$$

(where, in formula (2), D1 represents a circle-equivalent diameter of the titanium oxide particles in the undercoat layer, and R2 has the same definition as R2 in formula (1).

11. The electrophotographic photosensitive member according to claim 10, wherein the volume ratio of the titanium oxide particles represented by formula (1) is 5.0 or more and 20 or less.

12. The electrophotographic photosensitive member according to claim 10, wherein the titanium oxide particles are titanium oxide particles subjected to a surface treatment with an organometallic compound or an organosilicon compound.

13. The electrophotographic photosensitive member according to claim 10, wherein the zinc oxide particles are zinc oxide particles subjected to a surface treatment with an organosilicon compound, and the titanium oxide particles are titanium oxide particles subjected to a surface treatment with an organosilicon compound.

14. The electrophotographic photosensitive member according to claim 10, wherein the organosilicon compound has an amino group.

15. The electrophotographic photosensitive member according to claim 10, wherein the average primary particle diameter (R1) of the zinc oxide particles is 20 nm or more and 80 nm or less.

* * * * *